US006817376B2

(12) United States Patent
Morgan et al.

(10) Patent No.: US 6,817,376 B2
(45) Date of Patent: Nov. 16, 2004

(54) GEL HYDRATION TANK AND METHOD

(75) Inventors: Ronnie G. Morgan, Waurika, OK (US); Johnny W. Johnson, Duncan, OK (US); Rickey L. Morgan, Comanche, OK (US); James A. McGough, Duncan, OK (US); Michael R. Spaulding, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 182 days.

(21) Appl. No.: 10/071,075

(22) Filed: Feb. 8, 2002

(65) Prior Publication Data

US 2003/0150494 A1 Aug. 14, 2003

(51) Int. Cl.[7] ..... F17D 1/16; F17D 1/18

(52) U.S. Cl. ..... 137/14; 137/351; 137/565.3; 137/573; 137/574

(58) Field of Search ..... 137/573, 574, 137/565.3, 351; 166/308.1, 308

(56) References Cited

U.S. PATENT DOCUMENTS 18,201 A * 9/1857 Hammer ..... 137/573
1,976,879 A * 10/1934 Ewer ..... 137/573
2,047,539 A * 7/1936 Wolf ..... 137/573
2,137,300 A * 11/1938 Allen ..... 137/573
2,980,131 A * 4/1961 Williams ..... 137/573
3,126,906 A * 3/1964 Touzalin et al. ..... 137/573
4,518,261 A * 5/1985 Sekimoto et al. ..... 366/155.1
4,828,034 A 5/1989 Constien et al.
5,046,856 A 9/1991 McIntire
5,052,486 A 10/1991 Wilson

OTHER PUBLICATIONS

A PowerPoint presentation, initially authored by James McGough, was given to a customer on Jan. 23, 2001. The PowerPoint presentation is entitled "Conoco Hydration Tank."

Experimental field testing of the above reference invention occured on Jan. 25, 2001.

* cited by examiner

*Primary Examiner*—A. Michael Chambers
(74) *Attorney, Agent, or Firm*—John W. Wustenberg; Warren B. Kice

(57) ABSTRACT

The present invention relates to a gel hydration tank and method for hydrating gels for use in oil well treatment operations according to which a mixture of water and gel is introduced into the interior of the tank and flows through the tank before being discharged from the tank, whereby specific devices are used to deflect and/or re-direct fluid flow so as to increase the distance traveled for a given fluid volume element, which consequently increases the plug flow efficiency of the tank.

20 Claims, 2 Drawing Sheets

GEL HYDRATION TANK AND METHOD

BACKGROUND

This invention relates to a gel hydration tank and method for hydrating gels for use in oil and gas well treatment operations.

Well treatment fluids are often used in oil or gas wells for well completion procedures, to acidify the well formation, and/or increase the recovery of hydrocarbons from the well by creating fractures in the formations, and the like. Many well treatment fluids of this type are composed of water and polymer gel agents and are usually formed by transporting an appropriate polymer gel agent to the well site and mixing it with excess water before the mixture is transferred to a hydration tank. The mixture is introduced into the hydration tank and the finished fluid is withdrawn from the tank on a continuum, yet the mixture must be maintained in the tank an optimum time to allow the polymer gel agent to become hydrated to form a high viscosity well treatment fluid. Thus, the design of the hydration tank is important to ensure the above and thus form an optimum well treatment fluid.

DETAILED DESCRIPTION

Figure 1:
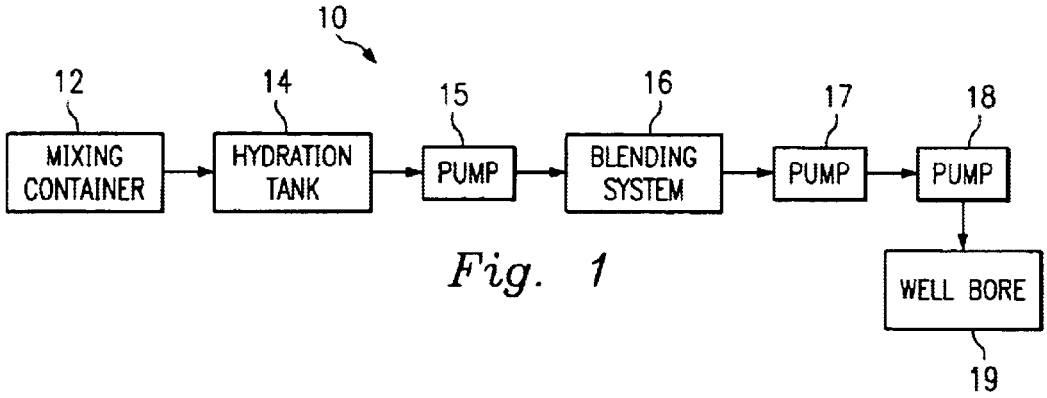
FIG. 1 is a diagrammatic view of a typical oil well treatment operation incorporating a hydration tank.

FIG. 1 illustrates a typical well treatment operation 10, where a high viscosity well treatment fluid is processed for introduction into subterranean well formations. In the well treatment operation 10, an appropriate polymer gel agent is transported to the well site, and placed in a mixing container 12. The polymer gel agent can include dry polymer additives, stabilized polymer slurries, aqueous liquid gel concentrates, and hydrocarbon-based liquid gel concentrates.

In the mixing container 12, the polymer gel agent is mixed with excess water and then transferred to a hydration tank 14 to allow time for the polymer gel agent to become hydrated to form a high viscosity well treatment fluid. Although the transformation from a polymer gel agent and water mixture to the resulting hydrated well treatment fluid is on a continuum, for the sake of simplicity the specification will refer to a fluid when it is not necessary to distinguish between the initial polymer gel agent and water mixture and the resulting hydrated well treatment fluid.

A pump 15 is used to transfer the hydrated fluid from the hydration tank 14 to a blending system 16, whereby sand or another proppant and other liquid additives are accurately metered and mixed with the hydrated gel. Then, another pump 17 transfers the mixture to high pressure pumps 18 that pressurize and transfer the final mixture to the well bore 19. In one embodiment, the well treatment operation 10 produces well treatment fluid substantially continuously. Thus, the hydration tank 14 must permit the flow of the well treatment fluid from the mixing container 12 to the pump 15 at a desired, substantially consistent, flow rate while allowing the fluid to remain in the hydration tank 14 for at least the hydrating period to ensure optimum viscosity for the resulting well treatment fluid. Thus, to establish an acceptable flow rate and residence time, the fluid should not "finger" ahead and enter the pump 15 before remaining in the hydration tank 14 for the hydration period.

Figure 2A:
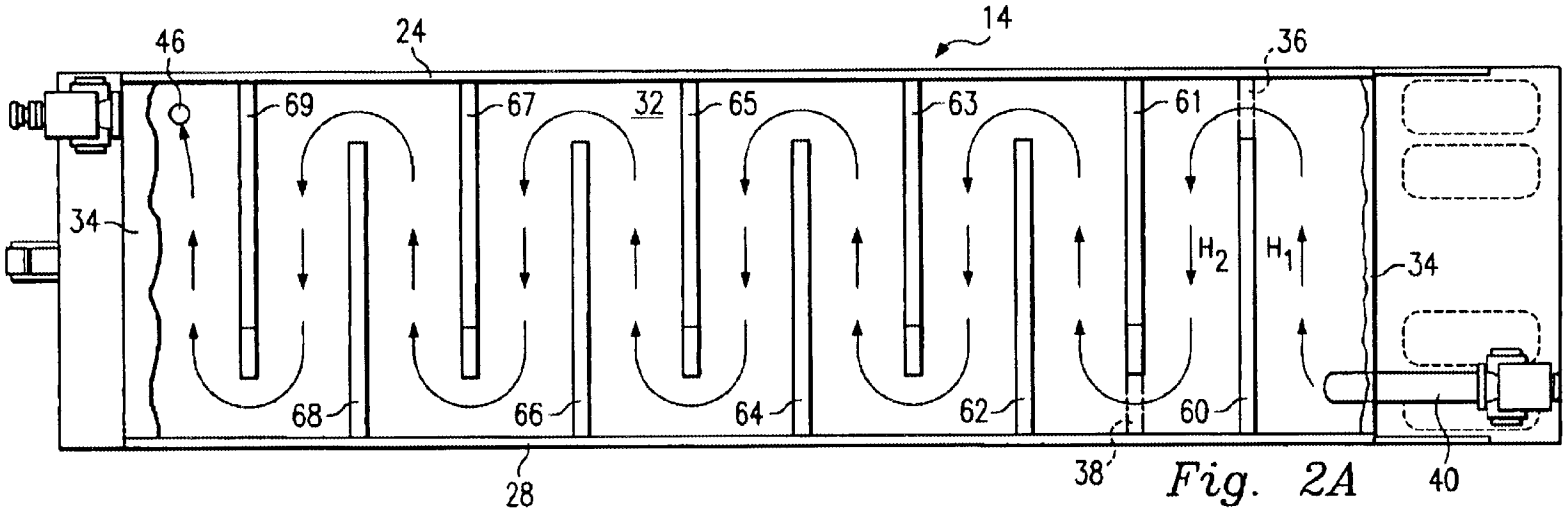
FIG. 2A is a top plan, broken-away, view of a hydration tank according to one embodiment of the present invention.
Figure 2B:
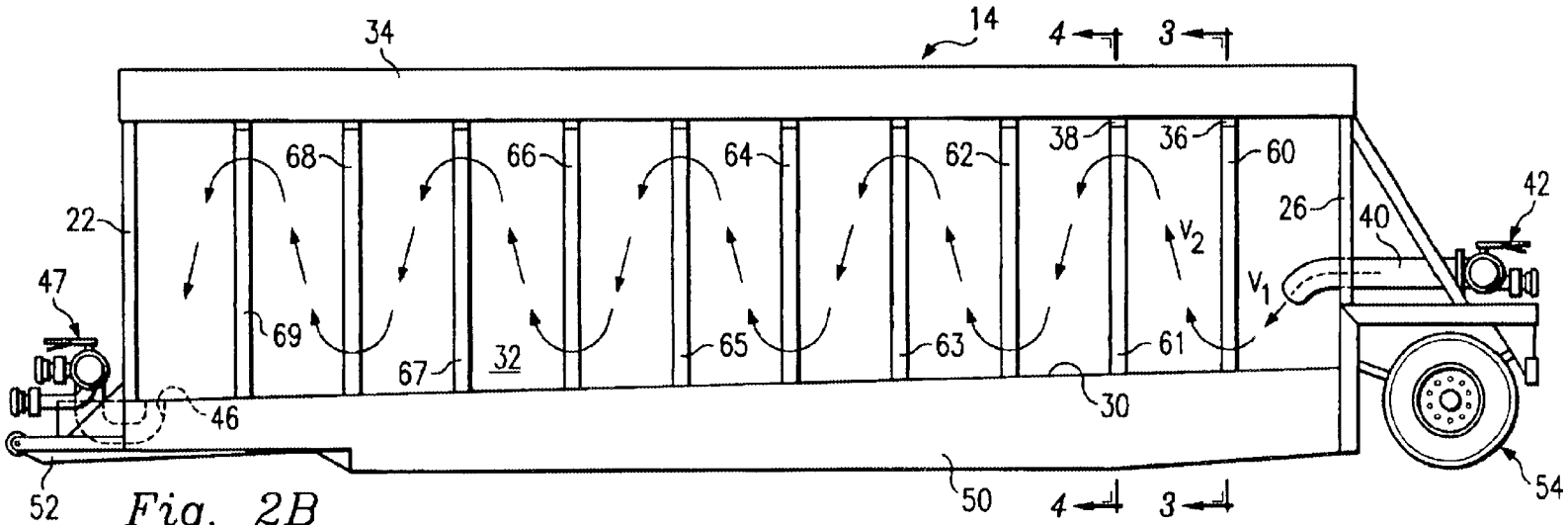
FIG. 2B is a side elevational view of the hydration tank of FIG. 2A.

As shown in FIGS. 2A and 2B, the hydration tank 14 according to one embodiment of the present invention includes a set of walls 22, 24, 26, and 28 (wall 28 is removed for clarity in FIG. 2B), extending perpendicular to a floor 30 and attached to the floor 30 in any conventional manner to define a fluid-tight interior portion 32. A top 34 (partially shown in FIG. 2A) may be placed on top of the hydration tank 14 via structural members 36,38 to cover the interior portion 32.

An inlet pipe 40 extends through the wall 26 and adjacent to the wall 28 for receiving the polymer gel agent and water from the mixing container 12 (FIG. 1 ) and introducing the fluid into the interior portion 32. Fluid entry is controlled by mixing container 12. An inlet valve 42 is provided for isolating the hydration tank 14 from the mixing container 12. An outlet pipe 46 extends from the interior portion 32 and adjacent to the wall 24 to the exterior of the hydration tank 14 for allowing the discharge of the hydrated well treatment fluid from the hydration tank 14. Fluid exit is controlled by the pump 15. An exit valve 47 is provided for isolating the hydration tank 14 from the blending system 16. Thus, there is a general fluid flow through the interior portion 32 from the inlet pipe 40 to the outlet pipe 46.

The hydration tank 14 is mobile and includes a base 50 with an attached connector 52 at one end for coupling to a conventional motive source, such as a truck (not depicted). A wheel assembly 54 is attached to the other end of the base 50.

Figure 3:
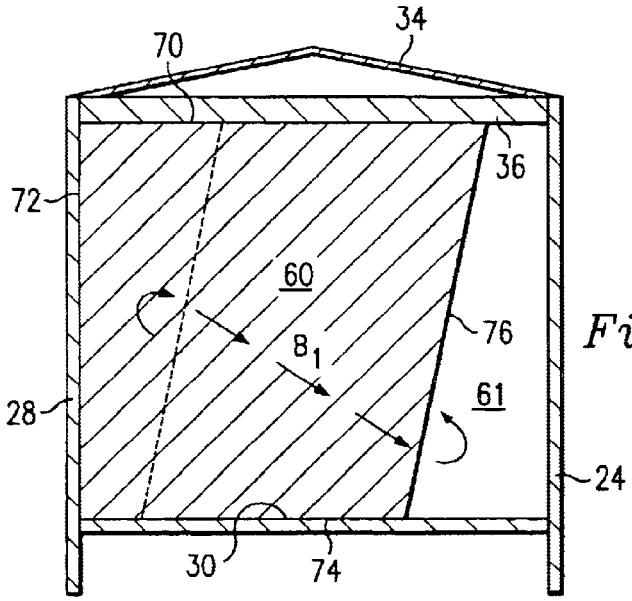
FIGS. 3 and 4 are cross-sectional views taken along the lines 3—3 and 4—4, respectively, of FIG. 2B.

A plurality of weirs 60–69 are disposed in the interior portion 32 of the hydration tank 14 in a spaced, parallel relation to establish a flow path of the fluid from the inlet pipe 40 to the outlet pipe 46. As shown in FIG. 3, the weir 60 is a flat, plate-like structure having a top 70, a flat side 72, a bottom 74, and a slanted side 76. The top 70 is attached to the structural member 36, which spans between wall 24 and wall 28 and is positioned adjacent to the top 34 of the hydration tank 14. The flat side 72 is attached to the wall 28, and the bottom 74 is attached to the floor 30. The slanted side 76 is spaced from the wall 24 and creates a specific directional path for fluid to flow.

Figure 4:
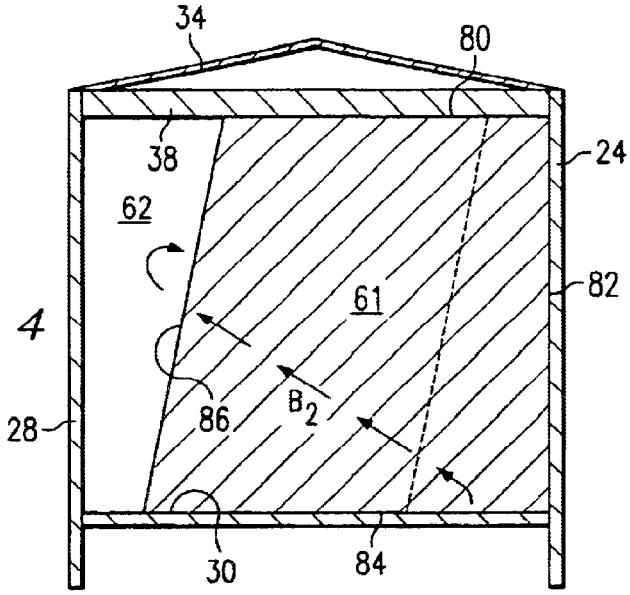

The weir 61 is shown in FIG. 4 and is also a flat, plate-like structure having a top 80, a flat side 82, a bottom 84, and a slanted side 86. The top 80 is attached to the structural member 38, which spans between wall 24 and wall 28 and is positioned adjacent to the top 34 of the hydration tank 14. The flat side 82 is attached to the wall 24, and the bottom 84 is attached to the floor 30. The slanted side 86 is spaced away from the wall 28, and creates a specific directional path for fluid to flow. Thus, the weir 61 is substantially similar to the weir 60, but is installed on the laterally opposing wall and is in an inverted orientation relative to the weir 60.

The weirs 62, 64, 66, and 68 are also connected to the wall 28 and are substantially identical to the weir 60; and the weirs 63, 65, 67, and 69 are also connected to the wall 24 and are substantially identical to the weir 61. Therefore, the weirs 62, 63, 64, 65, 66, 67, 68, and 69 will not be described in detail.

In operation, the fluid flows from the mixing container 12 (FIG. 1) and into the hydration tank 14 through the inlet pipe 40 (FIGS. 2A and 2B), before passing into and through the interior portion 32 of the hydration tank 14 and discharging from the outlet pipe 46. During this flow through the interior portion 32, the fluid is deflected by the weirs 60–69 in a manner to be described, and passes around the weirs 60–69, with each of the weirs 60–69 establishing its own fluid volume movement.

The general vector for the fluid volume movement for each of the weirs 60–69 is dependent on the above-described spaces between the slanted sides of the weirs and the relevant opposing wall. More particularly, the fluid entering the interior portion 32 of the hydration tank 14 from the inlet pipe 40 initially encounters the weir 60. The fluid volume movement around the weir 60 is shown in FIG. 3 by the reference arrow $B_1$. The fluid is blocked from passing between the weir 60 and each of the wall 28, the floor 30 and the top 34. Thus, the fluid must flow to the space between the wall 24 and the slanted side 76, generally to the right in FIG. 3. Also, since more fluid volume will pass through the relatively larger space between the wall 24 and portions of the slanted side 76 closer to the bottom 74, the flow is generally downwardly, as also shown by $B_1$.

The fluid next encounters the weir 61 described with reference to FIG. 4. The fluid is blocked from passing between the weir 61 and each of the wall 24, the floor 30 and the top 34. Thus, fluid must flow to the space between the wall 28 and the slanted side 86, generally to the left in FIG. 4 as shown by $B_2$. Also, since more fluid volume will pass through the relatively larger space between the wall 28 and portions of the slanted side 86 closer to the top 80, the flow is generally upwardly, as also shown by $B_2$.

It can be readily appreciated that each weir 60–69 establishes its own fluid volume movement, the even-reference numbered weirs 60, 62, 64, 66, and 68 producing fluid volume movements substantially similar to $B_1$, and the odd-reference numbered weirs 61, 63, 65, 67, and 69 producing fluid volume movements substantially similar to $B_2$.

Thus, the fluid flows in a direction in a horizontal plane of the hydration tank 14 as depicted in FIG. 2A and denoted by the reference arrow $H_1$; whereas the fluid then flows in another direction in a horizontal plane of the hydration tank 14 as denoted by the reference arrow $H_2$. The alternate juxtaposition of odd-reference numbered weirs 61, 63, 65, 67, and 69 and even-reference numbered weirs 60, 62, 64, 66, and 68, along the walls 24 and 28, respectively, and the staggered spaced openings, create an alternating pattern of flows $H_1$ and $H_2$.

Also, the fluid flows in a direction in a vertical plane of the hydration tank 14 as depicted in FIG. 2B and denoted by the reference arrow $V_1$; and in another direction in a vertical plane of the hydration tank 14 as denoted by the reference arrow $V_2$. As noted above, the alternate juxtaposition of the slanted sides of the odd-reference numbered weirs 61, 63, 65, 67, and 69 and even-reference numbered weirs 60, 62, 64, 66, and 68, create an alternating pattern of flows $V_1$, and $V_2$. Thus, the movement of fluid ($H_1$ and $H_2$, $V_1$ and $V_2$) through the hydration tank 14 in the above manner lengthens the distance traveled by the fluid, thus increasing the residence time to ensure hydration of the fluid in the hydration tank 14, and allows the use of faster flow rates.

Variations and Equivalents

It is understood that the number of weirs disposed in the hydration tank 14 is disclosed only for illustrative purposes and that the invention contemplates the use of any number of weirs to create a desired flow rate, the number and size of the weirs being readily calculable based on the hydration tank 14 dimensions and hydrating period. Furthermore, the plug flow efficiency will increase with additional number of weirs, up to a limit.

Furthermore, it is understood that while the weirs show a slanted side for deflecting the fluid, an embodiment is also contemplated wherein the weirs have straight sides and the walls of the hydration tank 14 are slanted to deflect the fluid. Moreover, although a mobile embodiment of the hydration tank 14 is depicted in the drawings, it is understood that the hydration tank 14 may have various immobile embodiments.

It is also understood that all spatial references, such as "top", "bottom", "left", "right", "front", "back", "downwardly", "upwardly", "horizontal", and "vertical" are for illustrative purposes only and can be varied within the scope of the invention.

Furthermore, it is understood that the essential flow patterns shown in the figures and described herein are for example only and the flow patterns may have directions other than horizontal and vertical.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims. For example, small holes may be cut in the bottom of each weir (at the intersection of floor 30 and bottom 74 in FIG. 3 and floor 30 and bottom 84 in FIG. 4) to facilitate complete drainage during cleanup.

What is claimed is:

1. A hydration method comprising:

defining an internal chamber within a set of wells;

introducing fluid into the chamber;

providing at least one weir extending from one of the walls and partially across the chamber towards an opposite wall;

spacing a surface of the weir from the opposite wall and defining, with the opposite wall, a first space for fluid flow between the weir and the opposite wall that varies along a dimension of the chamber;

providing at least one additional weir extending from the opposite wall and partially across the chamber towards the one wall, spacing a surface of the additional weir from the one wall and defining, with the one wall, a second space for fluid flow between the additional weir and the one wall that varies along another dimension of the chamber; so that the fluid flow from the inlet and through the spaces; and then discharging the fluid from the chamber.

2. The method of claim 1 wherein the one wall and the opposite wall form side walls of the tank and wherein there is a top wall and a bottom wall between which the weirs extend.

3. The method of claim 2 further comprising attaching the weirs to the top wall and to the bottom wall.

4. The method of claim 2 where the first space increases in a direction from the top well to the bottom wall and wherein the second space decreases in a direction from the top wall to the bottom wall.

5. The method claim 4 wherein the fluid flows in a general direction from the one wall, downwardly towards the opposite wall, through the first space, and upwardly towards the one wall.

6. The method of claim 1 wherein the one wall and the opposite wall form side walls of the tank and wherein two end walls extend parallel to the weirs.

7. The method of claim 6 wherein the weirs extend generally parallel to each other and to the end walls.

8. The method of claim 6 further comprising forming an inlet through one of the end walls for introducing the fluid and forming an outlet through the other end wall for discharging the fluid.

9. The method of claim 1 further comprising disposing the surface of the one weir at an angle to the opposite wall, and disposing the surface of the additional weir at an angle to the one wall.

10. The method of claim 1 wherein there are a plurality of weirs extending from the one wall and a plurality of weirs extending from the opposite wall, and further comprising disposing the weirs extending from the one wall in an alternating relationship with the weirs extending from the opposite wall along the length of the tank.

11. A hydration tank comprising:

a set of walls defining a internal chamber;

an inlet in fluid communication with the chamber for introducing fluid into the chamber;

an outlet in fluid communication with the chamber for discharging the fluid from the chamber;

at least one weir extending from one of the walls and partially across the chamber towards an apposite wall, a surface of the weir being spaced from the opposite wall and defining, with the opposite wall, a first space for fluid flow between the weir and the opposite wall that varies along a dimension of the chamber; and at least one additional weir extending from the opposite wall and partially across the chamber towards the one wall, a surface of the additional weir being spaced from the one wall and defining, with the one wall, a second space for fluid flow between the additional weir and the one wall that varies along another dimension of the chamber.

12. The tank of claim 11 wherein the one wall and the opposite wall form side walls of the tank and wherein there is a top wall and a bottom wall between which the weirs extend.

13. The tank of claim 12 wherein the weirs are attached to the top wall and to the bottom wall.

14. The tank of claim 12 where the first space increases in a direction from the top wall to the bottom wall and wherein the second space decreases in a direction from the top wall to the bottom wall.

15. The tank of claim 14 wherein the fluid flows in a general direction from the one wall, downwardly towards the opposite wall, through the first space, and upwardly towards the one wall.

16. The tank of claim 11 wherein the one wall and the opposite wall form side walls of the tank and wherein there are two end walls connected to the side walls.

17. The tank of claim 11 wherein the weirs extend generally parallel to each other and to the end walls.

18. The tank of claim 16 wherein the inlet is formed through one of the end walls and the outlet is formed through the other end wall.

19. The tank of claim 11 wherein the surface of the one weir extends at an angle to the opposite wall, and wherein the surface of the additional weir extends at an angle to the one wall.

20. The tank of claim 11 wherein there are a plurality of weirs extending from the one wall and a plurality of weirs extending from the opposite wall, the weirs extending from the one wall being disposed in an alternating relationship with the weirs extending from the opposite wall along the length of the tank.

* * * * *